US005806829A

United States Patent [19]

Banks

[11] Patent Number: 5,806,829

[45] Date of Patent: Sep. 15, 1998

[54] CONCRETE HOLE FORMER

[75] Inventor: Robert S. Banks, Cannon Falls, Minn.

[73] Assignee: Strike Tool, Cannon Falls, Minn.

[21] Appl. No.: 609,239

[22] Filed: Mar. 1, 1996

[51] Int. Cl.[6] ..... B28B 7/30

[52] U.S. Cl. ..... 249/11; 249/151; 249/177; 249/184

[58] Field of Search ..... 249/177, 145, 249/151, 184, 10, 11, 134

[56] References Cited

U.S. PATENT DOCUMENTS

| | | | |
|---|---|---|---|
| 3,715,958 | 2/1973 | Crawford et al. | 52/21 |
| 4,103,862 | 8/1978 | Moore | 249/53 R |
| 4,119,291 | 10/1978 | Polito | 249/11 |
| 4,177,229 | 12/1979 | Moore | 264/40.5 |
| 4,222,687 | 9/1980 | Williams | 408/79 |
| 4,318,880 | 3/1982 | McIntosh et al. | 264/267 |
| 4,365,780 | 12/1982 | Williams | 249/11 |
| 4,427,173 | 1/1984 | MacKay | 249/39 |
| 4,484,724 | 11/1984 | Srackangast | 249/11 |
| 4,625,976 | 12/1986 | Gilbert | 277/12 |
| 4,867,411 | 9/1989 | Dorsey et al. | 249/11 |
| 4,941,643 | 7/1990 | Ditcher | 249/145 |
| 4,997,215 | 3/1991 | Fournier | 285/230 |
| 5,413,307 | 5/1995 | Tidwell | 249/11 |
| 5,470,131 | 11/1995 | Nolan et al. | 299/41.1 |

*Primary Examiner*—Jay H. Woo
*Assistant Examiner*—Ivrie A. Schwartz
*Attorney, Agent, or Firm*—Kinney & Lange, P.A.

[57] ABSTRACT

A hole former for use in forming a concrete wall section having a hole extending therethrough. The concrete wall section is fabricated in a cavity that is defined by a first and a second form. The hole former comprises a plug and a preferably detachable suction cup. The suction cup retains the plug in a selected position between the first and second forms while concrete is being poured into the cavity.

13 Claims, 2 Drawing Sheets

78
74
72
76
80
84
10
82

12
96
14
94
98
92

CONCRETE HOLE FORMER

BACKGROUND OF THE INVENTION

The present invention relates generally to a hole former for use in fabricating concrete objects having holes formed therein. More particularly, the present invention relates to a hole former that is removably mountable to a concrete form using a suction cup.

The strength and durability of concrete has made concrete particularly well suited for many types of building and construction applications. However, the strength and durability of concrete makes it difficult to accurately form holes in the concrete objects after the concrete has cured. It has been found that the most efficient technique for forming many types of holes in concrete is to use plugs that are inserted into a concrete form prior to filling the concrete form with concrete.

One application where concrete is extensively used is in the fabrication of manholes. Concrete is particularly suited for fabrication of manholes because manholes are typically installed beneath roadways where the manholes must withstand the pressures associated with vehicles driving over the roadway.

In most applications, manholes are custom made to accommodate various locations, geometries, and sizes of pipes that intersect the manhole. Manholes are typically formed using concrete forms that are arranged to create a cavity. Hole formers are then attached to the concrete forms at selected locations within the cavity and the cavity is filled with concrete.

The prior art hole formers have a wall portion that extends around the outside of the hole former. The prior art hole formers also have a end portion that substantially encloses an end of the wall portion. The end portion has a plurality of holes extending therethrough.

The hole former is placed so that the end portion is adjacent to the concrete form. Holes are then drilled through the interior surface of the concrete form that conform with the holes in the end portion. Next, a wire is passed through the holes in the form and the end portion to fasten the hole former at a desired location on the concrete form.

A drawback of this fastening technique is that the holes in the concrete objects are typically at different locations thereby necessitating that numerous holes be drilled in the concrete form. The holes in the concrete form not only degrade the structural integrity of the concrete form but also provide locations that receive concrete and thereby increases the difficulty of removing the concrete form from the concrete object.

SUMMARY OF THE INVENTION

The present invention includes a hole former that is used in forming a concrete wall section having a hole extending therethrough. The concrete wall section is fabricated in a cavity defined by a first form and a second form.

The hole former includes a plug and a suction cup. The suction cup engages the plug and retains the plug in a desired position within the cavity.

DETAILED DESCRIPTION OF THE PREFERRED EMBODIMENTS

Figure 1:
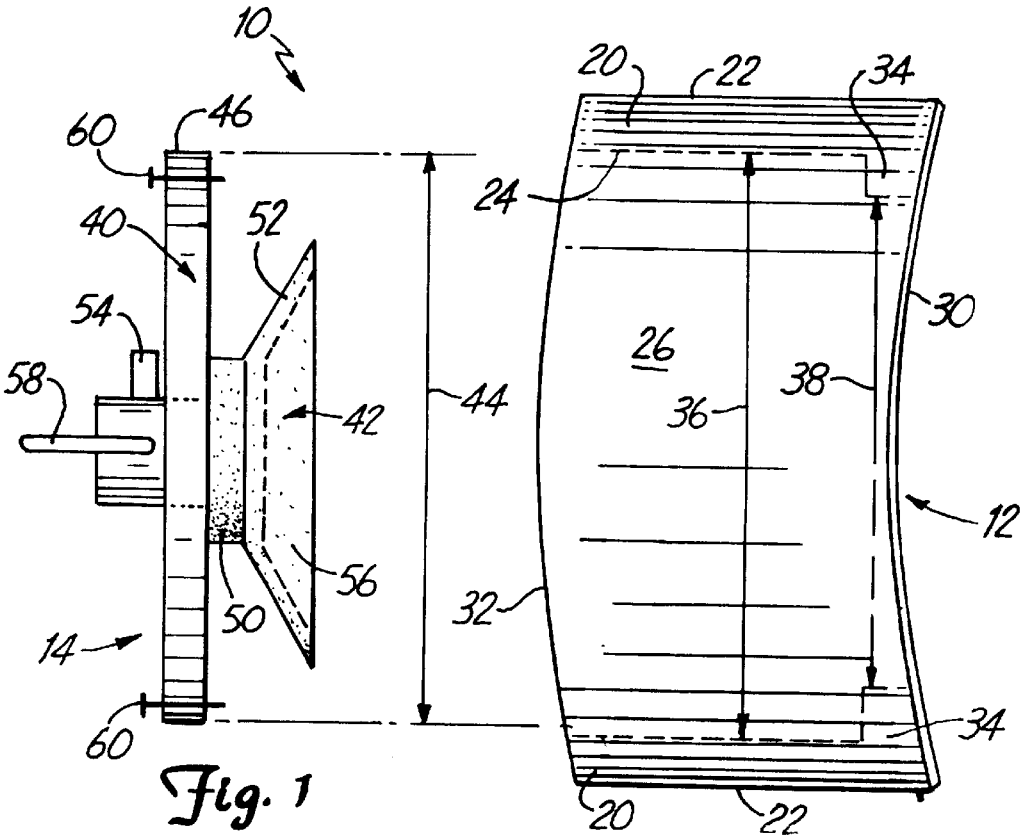
FIG. 1 is a side view of a suction cup assembly and a cylindrical plug.

The present invention is a hole former, generally indicated at 10, that includes a plug 12 and the suction cup assembly 14, as most clearly illustrated in FIG. 1. The plug 12 is selected with a size and geometry that corresponds with the desired hole that is to be formed in a concrete wall section. Preferably, the plug 12 has a generally cylindrical profile. However, the plug may also take the shape of other configurations.

The plug 12 is fabricated from a material that resists bonding with concrete and that is not degraded by contact with concrete. The plug 12 is preferably fabricated from ultra high molecular weight polyethylene. Other polymeric materials having the same or similar characteristics are also includeable within the present invention.

The plug 12 is preferably substantially cylindrical and has a wall portion 20 that extends around the outside of the plug 12. The wall portion 20 has an outer surface 22 and an inner surface 24. The wall portion 20 defines an interior region 26 that is located within the plug 12.

The wall portion 20 includes a first end surface 30 and a second end surface 32, which is opposite the first end surface 30. The first end surface 30 and second end surface 32 are shaped to substantially conform with surfaces of concrete forms that are placed adjacent to the end surfaces 30, 32. Conforming of the end surfaces 30, 32 with the concrete form surfaces substantially prevents concrete from passing around the end surfaces 30, 32 and into the interior region 26.

The outer surface 22 is slightly tapered so that an outer diameter of the plug 12 proximate to the first end surface 30 is preferably less than an outer diameter of the plug 12 proximate to the second end surface 32. The difference in outer diameters allows the plug 12 to be more easily removed from the concrete object after the concrete has cured.

Proximate to the first end surface 30, the plug 12 includes an annular shoulder portion 34 that inwardly extends from the inner surface 24. Except for the area of the annular shoulder portion 34, an inner plug diameter 36 is preferably substantially consistent throughout the cylindrical plug 12. An inner shoulder diameter 38 is smaller than the inner plug diameter 36.

The suction cup assembly 14 preferably includes a plate portion 40 and a suction cup portion 42. An outer diameter 44 of the plate is less than the inner plug diameter 36 but greater than the inner shoulder diameter 38 so that a peripheral edge 46 of the plate portion 40 engages the annular shoulder portion 34.

The suction cup portion 42 is preferably a conventional suction cup that includes a body section 50 and an outwardly flared section 52. The suction cup portion 42 is attached to the plate portion 40 through the body section 50. The outwardly flared section 52 is preferably constructed from a bendable polymeric material that allows the outwardly flared section 52 to bend to conform with the surface of the concrete form. A diameter of the outwardly flared portion 52 is preferably approximately 6 inches.

The suction cup assembly 14 preferably also includes a valve 54 that extends from the plate portion 40 opposite the suction cup portion 42. The valve 54 is in communication with an interior region 56 of the outwardly flared portion 52. The valve 54 thereby allows a vacuum to be pulled in the interior region 56 using conventionally known techniques to tightly fasten the suction cup assembly 14 to the concrete form.

The suction cup assembly 14 further preferably includes a handle 58 that is attached to the plate portion 40 opposite the suction cup portion 42. The handle 58 allows the suction cup assembly 14 to be grasped when attaching or removing the hole former 10 from the concrete form.

An advantage of the hole former 10 of the present invention is that the hole former 10 can be easily adapted for use when forming a variety of size holes in a variety of thicknesses of concrete. In particular, a thickness of the suction cup assembly 14 is preferably between about two and three inches when the outwardly flared section 52 is selected with a diameter of approximately 6 inches. The relatively narrow thickness of the suction cup assembly 14 allows the hole former 10 to be used in forming holes in relatively thin concrete wall sections.

The present invention is adaptable so that the suction cup assembly 14 may be used with a variety of plugs 12. In particular, plugs with a variety of outer diameters or geometries can be used with a given suction cup assembly 14 as long as the inner diameter of the plug 36 is greater than the outer diameter of plate 44 and the inner shoulder diameter 38 is less than the outer diameter 44. This flexibility is accomplished by varying the width of the annular shoulder portion 34.

The present invention is also suitable for use with prior art hole formers. As described above, the prior art hole formers typically contain a wall portion and an end portion that encloses an end of the wall portion. The prior art hole former is machined to remove part of the end portion while leaving an annular shoulder portion that inwardly extends from the wall portion, which is similar to the plug 12 illustrated in FIG. 1. This process of retrofitting prior art hole formers allows the benefits of the suction cup assembly 14 of the present invention to be realized while reducing the cost associated with replacing the entire prior art hole former.

To further increase the flexibility of the hole former 10, the suction cup assembly 14 preferably includes a plurality of screws 60 that extend through the plate portion 40. The screws 60 are preferably arranged around the outside of the plate portion 40 so that the screws 60 contact the annular shoulder portion 34. The screws 60 are independently adjusted to compensate for irregularities in the thickness of the annular shoulder portion 34. The screws 60 thereby help to maintain the end surface 30 in substantial contact with the surface of the concrete form. The use of screws 60 is particularly desirable when prior art hole formers are retrofitted as described in the preceding paragraph because the end portion of the prior art hole formers is typically not sufficiently thick so that the peripheral edge 46 may contact the annular shoulder portion 34.

Figure 2:
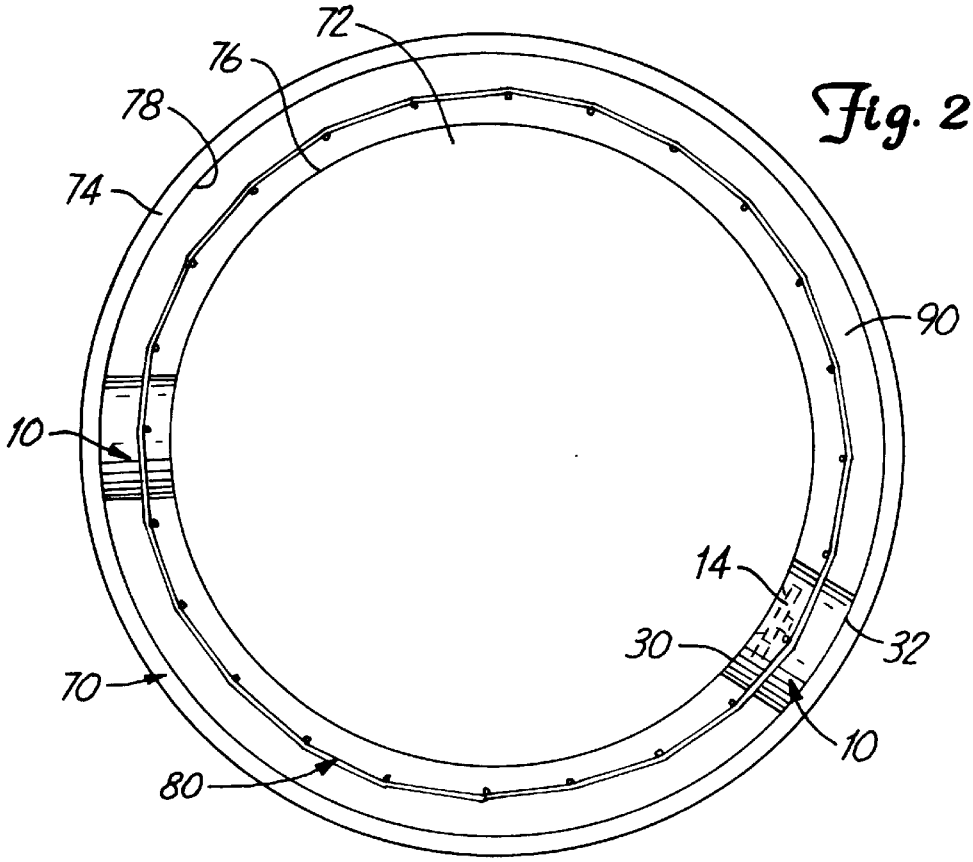
FIG. 2 is a top view illustrating use of a hole former according to the present invention.
Figure 3:
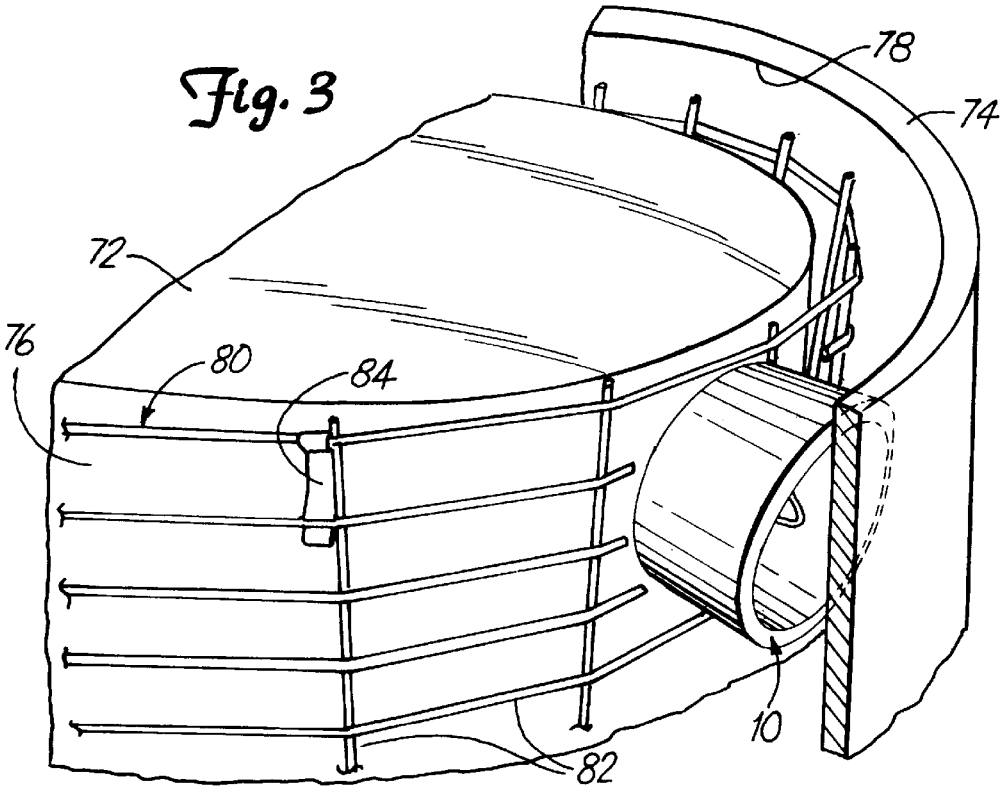
FIG. 3 is a perspective view of the hole former in use prior to pouring concrete.

The hole former 10 of the present invention removably attaches the plug 12 to a concrete form 70 using the suction cup assembly 14, as illustrated in FIGS. 2 and 3. Removably attaching the plug 12 to the concrete form 70 with the suction cup assembly 14 allows the hole former 10 to be retained in a desired location on the concrete form 70 without drilling holes in the concrete form 70. Because the hole former 10 is attached to the concrete form 70 without drilling holes in the concrete form 70, the hole former 10 may be placed at a variety of locations in the concrete form 70 without causing degradation of the concrete form 70 and without increasing the difficulty of separating the concrete form from the concrete object.

Prior to the present invention, adjusting the position of the hole former on the concrete form required additional holes to be drilled in the concrete form so that the prior art hole formers could be tied to the concrete form using wire. It can be appreciated that the integrity of the concrete form would be degraded over a long period of time as the number of holes in the form increases. Accordingly, prior art concrete forms that were used in conjunction with hole formers had limited life spans.

The concrete form 70 preferably has a first form portion 72 and a second form portion 74. The first form portion 72 and the second form portion 74 are selected to conform with the desired shape of the wall of the concrete object. When the concrete object is a substantially cylindrical concrete manhole, the first form portion 72 preferably has a substantially cylindrical outer surface 76 and the second form portion 74 preferably has a substantially cylindrical inner surface 78. The distance between the outer surface 76 and the inner surface 78 is selected so that a wall of the concrete object has sufficient strength based on the intended use of the concrete object.

A reinforcing rod grid 80 is preferably placed between the first form portion 72 and the second form portion 74 to further strengthen the concrete object. The reinforcing rod grid 80 is formed from a plurality of steel rods 82 that are fastened together in a perpendicular relationship. The size of the reinforcing rods 82 as well as the spacing of the reinforcing rods 82 in the reinforcing rod grid 80 are selected depending on the desired strength of the concrete object. The reinforcing rod grid 80 is preferably cut to remove portions of the reinforcing rod grid 80 where the hole formers 10 are to be attached to the outer surface 76.

It is known that the accurate placement of the reinforcing rod grid 80 within the concrete object affects the strength of the concrete object. Inaccurate placement of the reinforcing rod grid 80 within the concrete object could lead to a portion of the concrete object not having adequate strength, which in time could lead to collapse of the concrete object. To maintain the reinforcing rod grid 80 in a desired location while concrete is poured in the forms, the reinforcing rod grid 80 is typically stabilized with spacers 84.

Spacers 84 are attached to the reinforcing rod grid 80 at regular intervals to maintain the location of the reinforcing rod grid 80 within the concrete object.

In operation, the hole former 10 is attached to the first form portion 72 by placing the cylindrical plug 12 so that the first end surface 30 is substantially in contact with the cylindrical outer surface 76. The suction cup assembly 14 is placed within the interior region 26 so that the plate portion 40 engages the annular shoulder portion 34. The outwardly flared section 52 is in contact with the cylindrical outer surface 76.

Next, air is evacuated from the interior region 56 by pulling a vacuum through valve 54. The suction cup assembly 14 thereby retains the cylindrical plug 12 in a desired location on the cylindrical outer surface 76. The process of attaching the hole former 10 to the cylindrical outer surface 76 is then repeated as desired.

The second form portion 74 is now erected so that the second form portion 74 and the first form portion 72 form a concrete filling region 90. The second end surface 32 is substantially in contact with the cylindrical inner surface 78 to substantially separate the interior region 26 from the other portions of the concrete filling region 90. Concrete is then poured into the concrete filling region 90 to fill the concrete filling region 90 to a desired level.

Figure 4:
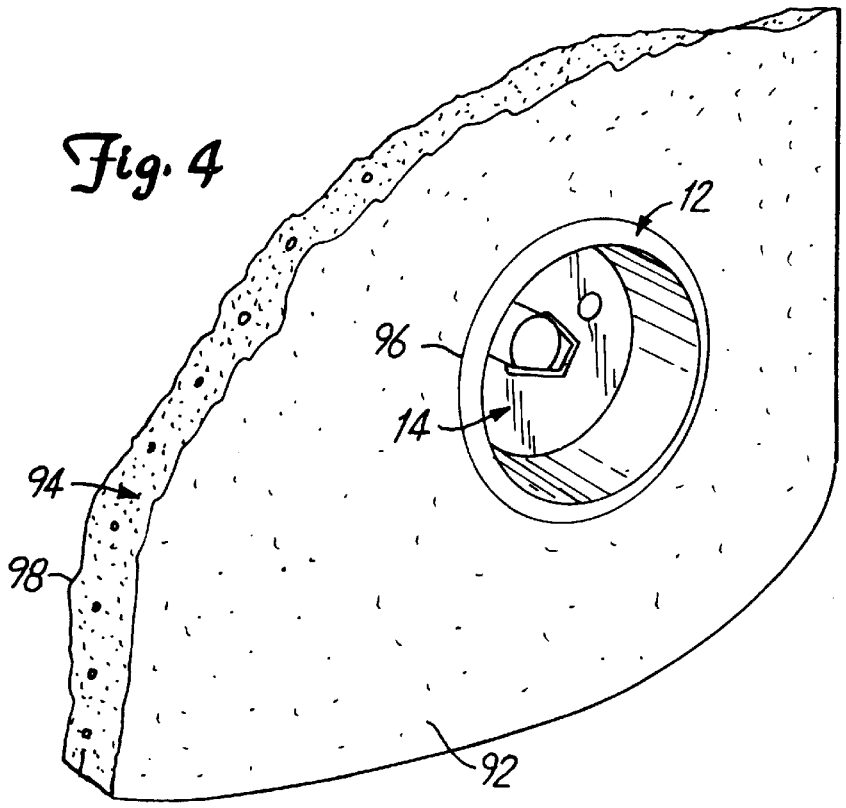
FIG. 4 is a perspective view illustrating of the hole former in a concrete wall section after the concrete forms have been removed.

To ensure that the concrete is distributed within the concrete filling region 90, the concrete is preferably vibrated using conventionally known techniques. The concrete is then allowed to harden. After the concrete has hardened, the second form portion 74 is removed from the concrete object to expose an outside surface 92 of a concrete object 94, as most clearly illustrated in FIG. 4.

The vacuum is released from the interior region 56 through valve 54. Release of the vacuum from interior region 56 allows the suction cup assembly 14 to be removed from inside the cylindrical plug 12. Next, the cylindrical plug 12 is removed from the concrete pipe to reveal a hole 96 that preferably extends from the outer surface 92 to an inner surface 98. Finally, the first form portion 72 is removed from the inner surface 98 to reveal the molded concrete object 94.

The hole former and method of the present invention thereby allow holes having a variety of geometries, widths, and thicknesses to be formed in concrete objects. The hole former and method of the present invention also provides flexibility of locating the hole formers on a variety of locations on the forms without drilling holes through the forms for use in fastening the hole formers. The present invention thereby enables the forms to be used for a considerably longer duration before replacement is needed.

Although the present invention has been described with reference to preferred embodiments, workers skilled in the art will recognize that changes may be made in form and detail without departing from the spirit and scope of the invention.

What is claimed is:

1. A hole former for use in forming a concrete wall section having a hole extending therethrough, the concrete wall section being fabricated in a cavity defined by a first form and a second form, the hole former comprising:

a plug defining a hole forming region, the plug capable of extending within the cavity between the first form and the second form; and a suction cup attached to the plug for retaining the plug in a selected position within the cavity by attachment to the first form.

2. The hole former of claim 1 and further comprising a plate attached to the suction cup, the suction cup engaging the plug through contact with the plate.

3. The hole former of claim 2 and further comprising a valve attached to the plate opposite the suction cup, wherein the valve is in communication with an interior region of the suction cup.

4. The hole former of claim 2, wherein the plug has a wall portion and an annular shoulder portion inwardly extending from the wall portion, the plate engaging the annular shoulder portion.

5. The hole former of claim 4 and further comprising a plurality of screws extending through the plate and contacting the annular shoulder portion.

6. The hole former of claim 1, wherein the plug is tapered so that an end of the plug that is adjacent to the first form is wider than an end of the plug that is adjacent to the second form.

7. The hole former of claim 1, wherein a first edge surface of the plug substantially conforms with a surface of the first form and wherein a second edge surface of the plug, which is opposite the first edge surface, substantially conforms with a surface of the second form.

8. The hole former of claim 1 and further comprising a handle attached to the suction cup.

9. A device for retaining a hole former in a selected location between a first concrete form and a second concrete form, wherein the hole former extends between the first form and the second form to produce a hole that extends through a concrete wall section, the device comprising a suction cup removably attached to the hole former, the suction cup being capable of engaging the first form to retain the hole former in a selected position between the first concrete form and the second concrete form.

10. The device of claim 9 and further comprising a plate attached to the suction cup, the suction cup engagable with the hole former through the plate.

11. The hole former of claim 10 and further comprising a valve attached to the plate opposite the suction cup, wherein the valve is in communication with an interior region of the suction cup.

12. The device of claim 10 and further comprising a plurality of screws extending through the plate.

13. The device of claim 10 and further comprising a handle attached to the plate opposite the suction cup.

* * * * *